US005136548A

United States Patent [19]

Claar et al.

[11] Patent Number: 5,136,548

[45] Date of Patent: Aug. 4, 1992

[54] REMOTE-CONTROL SYSTEM FOR CLOSURES

[75] Inventors: Klaus Claar, Gechingen; Martin Lindmayer, Böblingen, both of Fed. Rep. of Germany

[73] Assignee: Mercedes-Benz AG, Fed. Rep. of Germany

[21] Appl. No.: 709,318

[22] Filed: Jun. 3, 1991

[30] Foreign Application Priority Data

Jun. 7, 1990 [DE] Fed. Rep. of Germany ..... 4018261

[51] Int. Cl.[5] ..... G10K 11/00

[52] U.S. Cl. ..... 367/2; 367/137; 367/903; 367/197

[58] Field of Search ..... 367/903, 197, 137, 2; 340/825.57; 318/286

[56] References Cited

U.S. PATENT DOCUMENTS 2,543,789 3/1951 MacMillan ..... 318/286

FOREIGN PATENT DOCUMENTS 3240945 5/1984 Fed. Rep. of Germany .
3043627 12/1987 Fed. Rep. of Germany .
3830511 5/1989 Fed. Rep. of Germany .
4006125 3/1991 Fed. Rep. of Germany .

*Primary Examiner*—Daniel T. Pihulic
*Attorney, Agent, or Firm*—Evenson, Wands, Edwards, Lenahan & McKeown

[57] ABSTRACT

A remote-control system for closures with a movable hand transmitter with at least one transmission key, this transmitter generating and radiating directed coded control signals upon actuation of the transmission key of the hand transmitter. At least one first receiver unit is tuned to receive the control signals radiated from the hand transmitter and is arranged on a motor vehicle and triggers switching effects on a remotely controllable vehicle locking after the received control signals have been identified as acceptable. At least one second receiver unit is tuned to receive control signals radiated as a result of the actuation of the transmission key of the hand transmitter for remotely controlling a remotely controllable access control device external to the motor vehicle. This second receiver unit is arranged outside the motor vehicle and triggers switching effects on the access control device after the received control signals have been identified as acceptable. An electrical circuit is provided for preventing at least the triggering of switching effects by the second receiver unit when the control signal radiated as a result of a single actuation of the transmission key of the hand transmitter is received simultaneously by the first and the second receiver unit, by causing to arrive at the second receiver unit only a control signal which significantly differs from the control signal radiated as a result of the actuation of the transmission key of the hand transmitter for remotely controlling the access control device. At least one transmitter is fixed to the motor vehicle, this transmitter being randomly electrically activatable from a passenger space of the motor vehicle independently of the hand transmitter. The transmitter is arranged on the outside of the motor vehicle for direct radiation to the outside of control signals coded in accordance with the control signals radiated by the hand transmitter. This ensures that only one code has to be impressed on the control signals of the hand transmitter in order to make it possible to use the hand transmitter for the direct remote control both of the vehicle locking and of the access control device.

23 Claims, 3 Drawing Sheets

REMOTE-CONTROL SYSTEM FOR CLOSURES

BACKGROUND AND SUMMARY OF THE INVENTION

The present invention relates to a remote-control system for closures, having a portable hand held transmitter which generates and radiates directed coded control signals upon actuation of a transmission key on the hand transmitter. At least one first receiver unit is tuned to receive the control signals radiated from the hand transmitter and is arranged on a motor vehicle and triggers switching effects on a remotely controllable vehicle locking device after the received control signals have been identified as acceptable. At least one second receiver unit is tuned to receive control signals radiated as a result of the actuation of the transmission key of the hand transmitter for remotely controlling a remotely controllable access control device (such as a garage door, or the like) external to the motor vehicle. This second receiver unit is arranged outside the motor vehicle and triggers switching effects on the access control device after the received control signals have been identified as acceptable. An electrical circuit is provided for preventing at least the triggering of switching effects by the second receiver unit when the control signal radiated as a result of a single actuation of the transmission key of the hand transmitter is directed simultaneously to the first and the second receiver unit, by causing the signal arriving at the second receiver unit to differ significantly from the control signal radiated as a result of the actuation of the transmission key of the hand transmitter for remotely controlling the access control device.

A remote-control system with the above features has already been described in German Patent Document DE 4,006,125 C1. In this system, the infrared hand transmitter is used outside the vehicle for the remote control of the central door locking of the vehicle via at least one first receiver fixed to the vehicle, and also inside the vehicle for the convenient remote control of an external access control device, for example an electrical garagedoor drive, via a second receiver external to the vehicle. However, inside the vehicle, the control signals of the hand transmitter are transmitted to the second receiver via a lightguide cable which terminates in an interior hand-transmitter receptacle fixed to the vehicle and in the shell of the motor vehicle. This allows providing a plurality of outer terminations of the light-guide cable branched for this purpose.

In a simple version of the known system, if desired, technical safety precautions against an unintended simultaneous response of both the vehicle locking and the drive of the external system when the two receivers receive the hand-transmitter signal simultaneously can be relinquished in favor of a remote control ability of the external access control device which is direct, that is to say also external to the vehicle. Damage to the vehicle or to the access control device, should the vehicle be parked immediately in front of an electrically drivable garage door, can be avoided if the user takes appropriate care.

However, for the system of the above-described type there are electrical means for suppressing switching effects of the second receiver when signals radiating from the hand transmitter are received simultaneously by the first and second receivers. The switching effects of control signals received by the respective receiver units and identified as suitable occur especially: on the vehicle/at the first receiver unit in the central unlocking and locking of all of the closures; and at the access control device/second receiver unit in the opening and reclosing of an outside door, barrier, etc.

According to a first embodiment, the means for suppressing are formed by a signal converter which is provided within the light-guide cable and which converts the signal of the hand transmitter into the form or coding which can be evaluated by the second receiver unit. According to a second embodiment of the known system, an independent transmitter can be installed in the vehicle itself, and this can be activated via a first portion of the light-guide cable only by the activation of the hand transmitter inserted into the receptacle and thereupon radiates, via a second portion of the light-guide cable towards the outer termination thereof, a signal differing from the control signals of the hand transmitter. Here, therefore, in contrast to the two designs described above, it is necessary to have at least one additional transmitter, which, however, works solely in dependence on the activation of the hand transmitter. These technical safety precautions make sure that the external access control device cannot be controlled directly by the hand transmitter outside the vehicle.

In another known remote-control system (German Patent Document DE 3,043,627 C2) with a movable infrared hand transmitter which can be used outside a vehicle for the remote control of the vehicle locking or of an electrical garage-door drive, there are no technical safety precautions against the simultaneous reception of the hand-transmitter signal by the vehicle receiver and the garage-door receiver.

There is also known a remote-control system (U.S. Pat. No. 2,543,789) which allows the control of the garage-door drive via two receivers external to the vehicle and two corresponding transmitters arranged fixed in a vehicle. The latter are jointly activatable from the passenger space by means of a switch for signal generation and transmission. Here, as a technical safety precaution, there is an AND conjunction between the two transmitter signals according to the receivers, but this merely ensures that the garage-door drive responds only when the two transmitter signals are received simultaneously. A remote control of a vehicle-locking function and a transmitter arrangement releasable from the vehicle are not disclosed in U.S. Pat. No. 2,543,789. Any safety precautions of the type mentioned earlier are therefore also superfluous.

Another remote-control system which provides solely for operating a central vehicle locking and belongs to a theft-prevention device for motor vehicles is described in German Patent Document DE 3,240,945 A1. In this system, to protect the vehicle against unauthorized re-use of a code signal transmitted contactlessly from a hand transmitter to the vehicle and inadmissibly recorded, there is installed in or on the vehicle a transmitter which can be activated by the hand transmitter via the receiver fixed to the vehicle. After the transmitter is activated, it emits an all-round interference signal which is intended to be superposed on the hand-transmitter code signal everywhere except at the location of the receiver itself fixed to the vehicle and which, because of its similarity, cannot immediately be separated from this code signal. Apart from the protective effect of the interference signal, no effective use of the transmitter fixed to the vehicle, for example for control purposes, is disclosed. Also, except by activation by the hand transmitter, it cannot be activated at random by the user.

There is also known a central locking system (German Patent Document DE 3,830,511 C1) the electronic control of which gives the user the possibility of unlocking only the driver's door closure individually by actuating its closing point once in the unlocking direction, or of unlocking all the closures of the vehicle centrally by actuating the same closing point twice in quick succession in the unlocking direction.

An object of the invention is to provide a remote-control system of the relevant generic type, already containing technical safety precautions against possible operating errors or undesired simultaneous activation of the vehicle locking and access control device, in such a way that the hand transmitter can nevertheless also be used for the direct control of the access control device.

This and other objects ar achieved by the present invention which provides a remote-control system for closures with a portable hand held transmitter which generates and radiates directed coded control signals upon actuation on the transmission key of the hand held transmitter. At least one first receiver unit is tuned to receive the control signals radiated from the hand transmitter and is arranged on a motor vehicle triggers switching effects on a remotely controllable vehicle locking device after the received control signals have been identified as acceptable. At least one second receiver unit is tuned to receive control signals radiated as a result of the actuation of the transmission key of the hand transmitter for remotely controlling a remotely controllable access control device external to the motor vehicle. This second receiver unit is arranged outside the motor vehicle and triggers switching effects on the access control device after the received control signals have been identified as acceptable. An electrical circuit is provided for preventing at least the triggering of switching effects by the second receiver unit when the control signal radiated as a result of a single actuation of the transmission key of the hand transmitter is received simultaneously by the first and the second receiver unit, by causing to arrive at the second receiver unit only a control signal which significantly differs from the control signal radiated as a result of the actuation of the transmission key of the hand transmitter for remotely controlling the access control device. At least one transmitter is fixed to the motor vehicle, this transmitter being randomly electrically activatable from a passenger space of the motor vehicle independently of the hand transmitter. The transmitter is arranged on the outside of the motor vehicle for direct radiation to the outside of control signals coded in accordance with the control signals radiated by the hand transmitter.

The vehicle acquires at least one outer transmitter which can be activated electrically from the vehicle interior and independently of the hand transmitter. Moreover, filed in the vehicle is at least one code which corresponds to that filed in the hand transmitter and which serves for coding the signal radiated from the outer transmitter, so that this can radiate directly outwards, especially to the second stationary receiver unit of the access control device, at least control signals coded in accordance with the control signals of the hand transmitter. Because the signals which can be radiated from the hand transmitter for the purpose of the remote control of the access control device differ significantly, as a result of technical safety precautions, from those which can be radiated for the purpose of the remote control of the vehicle locking, the remote control of the access control device both directly by the hand transmitter and from the vehicle independently of the hand transmitter is therefore possible without any loss of safety.

According to advantageous developments of the system according to the invention, the technical safety precautions preventing the drive of the access control device external to the vehicle from responding in the event of a remote control of the vehicle locking can preferably be that a single activation of the hand transmitter by means of its only transmission key is sufficient for the remote control of the vehicle locking, whereas said hand transmitter has to be activated more than once, especially twice in quick succession, for the remote control of the access control device, a single control signal of the hand transmitter not being identified as suitable by the receiver unit of the access control device, and in a further improvement the same code signal being generated automatically more than once, especially twice in succession, by the activation of the at least one vehicle transmitter, or that, although a single activation of the hand transmitter is sufficient for the remote control of both the vehicle locking and the access control device, nevertheless when the hand-transmitter control signal is received at the first receiver unit an (interference or blocking) signal different from this is radiated via the at least one outer transmitter of the vehicle, is superposed on the hand-transmitter control signal outside the vehicle, and consequently prevents it from being identified as suitable by the second receiver unit.

Other objects, advantages and novel features of the present invention will become apparent from the following detailed description of the invention when considered in conjunction with the accompanying drawings.

DETAILED DESCRIPTION OF THE DRAWINGS

Figure 1:
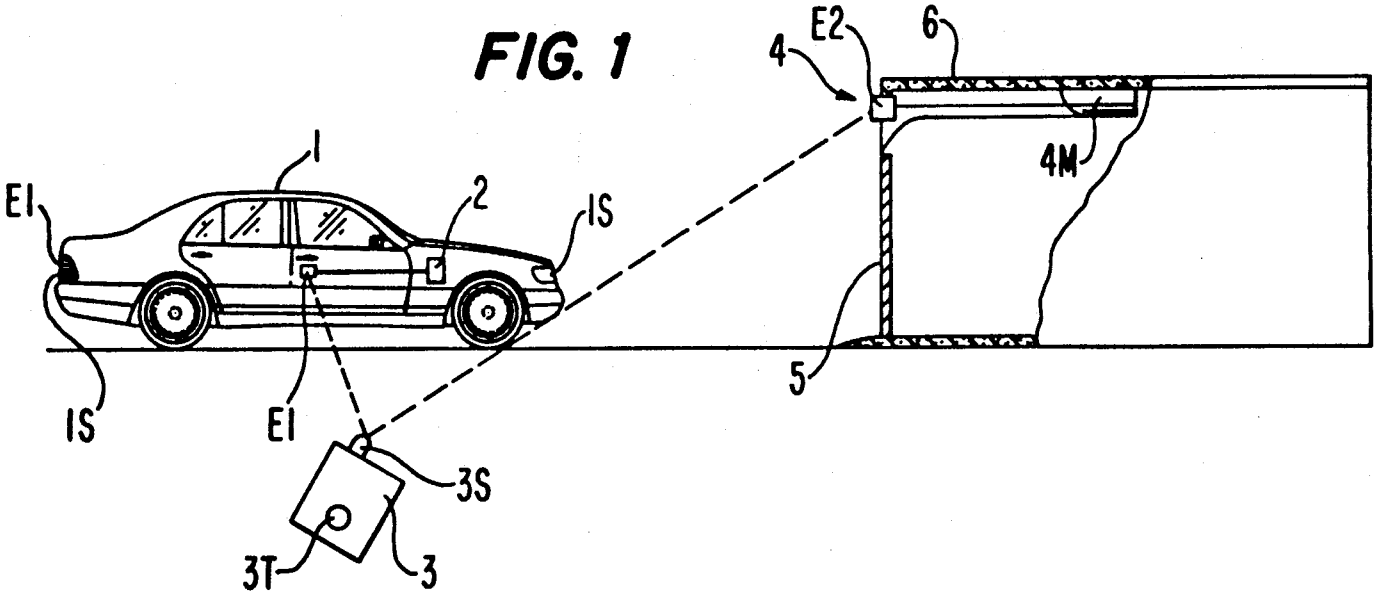
FIG. 1 shows a diagrammatic general view of a motor vehicle and of an access control device and a hand transmitter for the remote control of both a vehicle locking and a drive of the access control device constructed according to an embodiment of the present invention.

In FIG. 1, a motor vehicle 1 is equipped with a laterally mounted first receiver E1 and with a control unit 2 connected to this and belonging to a central locking system, not shown in any more detail, which is remotely controllable by means of a hand transmitter 3. First receivers E1 are likewise arranged at the rear of the vehicle 1 and on its side facing away from the observer, so that the central locking system can be controlled remotely in a known way from a plurality of points (e.g. driver's door, front-seat passenger's door and trunk lid).

Figure 2:
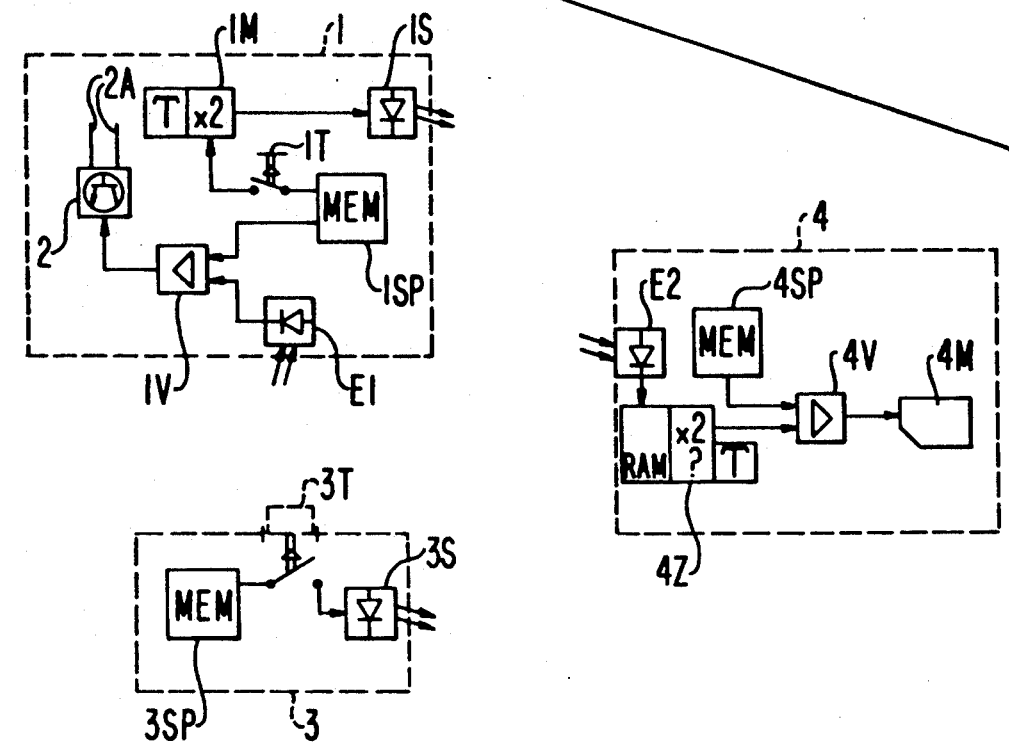
FIG. 2 shows a diagrammatic representation of a circuit constructed according to an embodiment of the present invention that is external to the vehicle for protecting the remote-control system against the undesired triggering of switching effects.

At least one transmitter 1S intended for radiating coded control signals is mounted on the outside of the vehicle 1 at the front and rear, respectively. These transmitters IS can be activated from the vehicle interior at random and independently of the hand transmitter 3 by means of a switch (FIG. 2). An access control device 4 is represented in FIG. 1 in the form of a garage door 5 of a garage 6 which is drivable electrically in a known way by means of a drive 4M. The access control device 4 can be controlled remotely via a second receiver E2 by means of control signals radiated from the hand transmitter 3. Furthermore, it can also be controlled remotely via the same second receiver E2 by means of control signals radiated for its activation by the transmitter 1S fixed to the vehicle.

In the preferred exemplary embodiment, all the transmitters are infrared transmitting diodes and all the receivers as infrared receiving diodes, so that the coded control signals can be transmitted contactlessly in a known way by means of infrared light waves. However, other wave forms (radio, ultrasonic) can also be used for signal transmission in the remote-control system according to the invention. Furthermore, the term "on the outside of the vehicle" does not require that the transmitters 1S has to be arranged directly in the vehicle shell, that is to say in the body sheet or other parts. It is only necessary for the arrangement according to the present invention merely that a direct transmission of control signals from these transmitters to the second receiver external to the vehicle is possible. For this, however, the particular transmitter can perfectly well be arranged behind a cover, which must naturally be transparent for infrared transmission. Furthermore, electrical voltage supplies for all the components which are to be fed electrically, but which are not shown specifically here are provided in the vehicle 1, in the hand transmitter 3 and in the access control device 4. A battery chargeable during driving via the power supply of the vehicle 1 is preferably installed in the hand transmitter 3.

The term "access control device" can embrace not only a garage-door drive, but also other devices, for example barrier systems in front of parking areas or in front of other traffic areas not accessible to public traffic, such as factory land or barracks, as instances of use of the remote-control system according to the present invention.

Assume the movable hand transmitter 3 is outside the motor vehicle 1 and at some distance from the vehicle I. It is equipped in a known manner with a transmission key 3T and with an infrared emitter 3S which is provided for radiating the coded control signals and for the remote control of the central locking system via its receivers E1. In certain embodiments, the hand transmitter 3 is combined in a known manner with the mechanical ignition key (not shown).

The broken lines in FIG. 1 represent the beam path of the control signals which can be radiated from the hand transmitter 3. As is evident in the illustrated exterior position of the hand transmitter 3, because of unavoidable diffusion this can extend from the emitter 3S both to the lateral first receiver E1 on the motor vehicle and to the second receiver E2 of the access control device 4.

Since both the vehicle locking (receiver E!, control unit 2) and the access control device 4 (receiver E2, drive 4M) are to be remote-controlled from outside by means of the hand transmitter 3 (emitter 3S) as a result of the actuation of its single transmission key 3T, and furthermore the access control device 4 is to be remote-controlled by means of the activation of the transmitters IS fixed to the vehicle, it is provided that the radiatable signals both of the hand transmitter 3 and of the transmitters 1S are coded in an identical manner. It is therefore also necessary to file on the reception side in the vehicle 1 and in the access control device 4 only one coding, by means of which the control signals received respectively from the first and second receivers E1 and E2 can be identified as suitable.

FIG. 2 shows that code stores 1SP and 3SP are provided both in the vehicle 1 and in the hand transmitter 3 and can be connected to the respective transmitters 1S and 3S via a touch-contact switch 1T or the transmission key 3T.

In the vehicle 1, the code store 1SP is also connected to one input of a comparator IV, so that the code filed in the store is permanently available at this comparator input. The first receiver E1 is connected to a second input of the same comparator 1V. The other first receivers E1 mounted at various locations on the vehicle 1 are also connected to identical circuits or, for example via an OR element, to the same comparator 1V. Whenever the transmission key 3T of the hand transmitter 3 is actuated when the hand transmitter 3 is at a distance from one of the first receivers E1 located within the range of the emitter 3S, the radiated control signal arrives contactlessly at this receiver E1 and is applied to the comparator IV. After the control signal has been identified as suitable by the comparator 1V by means of the code filed in the store 1SP, the control unit 2 is activated for the purpose of operating the central locking system via its outputs 2A.

In the access control device 4, too, there is provided a code store 4SP which is connected at its output to one input of a comparator 4V, so that the code filed in the code store 4SP is permanently available at this comparator input.

It should be noted at this juncture that in functional terms a receiver, a comparator and a code store (E1, 1SP, 1V or E2, 4SP, 4V) respectively constitute a technical unit, namely a receiver unit, from which it can be formulated that a switching effect is triggered by a receiver unit after a received control signal has been identified as suitable. Of course, an amplifier is further respectively provided for this purpose which is preferably combined with the respective comparator in a constructional unit.

The receiver E2 of the access control device 4 is connected via a counting stage 4Z to another input of the same comparator. The counting stage 4Z passes a coded control signal received from the receiver E2 to the comparator 4V only when this coded control signal is received twice in succession within a short period of time defined by an internal timer (not shown). The access control device 4 therefore does not react to a single reception of a coded control signal from the hand transmitter 3 or the transmitter IS fixed to the vehicle, even when the correct code has been impressed on this.

Thus, for the purpose of the remote control of the access control device 4, that is for the opening or closing of the garage door or a barrier, the transmission key 3T of the hand transmitter 3 has to be deliberately actuated by the user twice in quick succession. Although this may entail a slight loss of convenience, it can nevertheless be accepted immediately in view of the technical safety precaution thereby afforded in a simple manner. After the period of time defined by the timer has elapsed, once again only the double reception of a control signal identifiable as suitable can activate the access control device 4.

The received control signal always still has to be identified as suitable by the comparator 4V, by means of the code filed in the store 4SP, before the access control device 4 is activated. This can be carried out, for example, by also further assigning to the counting stage 4Z an internal intermediate read-write store (not shown) which can repeatedly be overwritten with newly received control signals and the content of which is erased, for example, each time immediately after the defined period of time has elapsed. After the same control signal has been received twice within the period of time, as recorded by the counting stage 4Z, the control signal now located in the intermediate store is then applied to the corresponding input of the comparator 4V.

In the above-described embodiment, therefore, by means of the counter stage 4Z an electrical circuit external to the vehicle for preventing at least the triggering of switching effects by the second receiver unit when a control signal radiated in response to a single actuation of the transmission key of the hand transmitter for the purpose of the remote control of the vehicle locking is received simultaneously by the first and the second receiver unit is provided. At least in this instance of reception, there arrives at the second receiver unit E2 only a control signal which differs significantly, particularly in number, from a control signal triggered and radiated as a result of the necessary double actuation of the transmission key 3T of the hand transmitter 3 for the purpose of the remote control of the access control device 4.

As is evident, in the vehicle 1 a signal repetition circuit 1M is provided so that in the event of only a single actuation of the transmission or touch-contact switch 1T which is internal to the vehicle and which can have a separate key within reach of the vehicle driver, the coded control signal is automatically radiated more than once in succession from the transmitter 1S. The touch-contact switch could also be closed, for example, by means of the headlamp flasher switch or another touch-contact switch already present in any case in the vehicle 1. Since there is virtually no possibility that signals radiated from this transmitter IS will be reflected on one of the first receivers E1 fixed to the vehicle with an intensity sufficient to trigger switching effects on the vehicle locking, no specific protective measures need be taken here, apart from the expedient orientation of the transmitters IS or receivers E1 relative to one another.

The signal repetition circuit 1M can also be omitted, but it is then also necessary for the user each time to actuate the touch-contacts switch 1T twice within the vehicle 1 when he wants to control the access control device 4 remotely.

Figure 3:
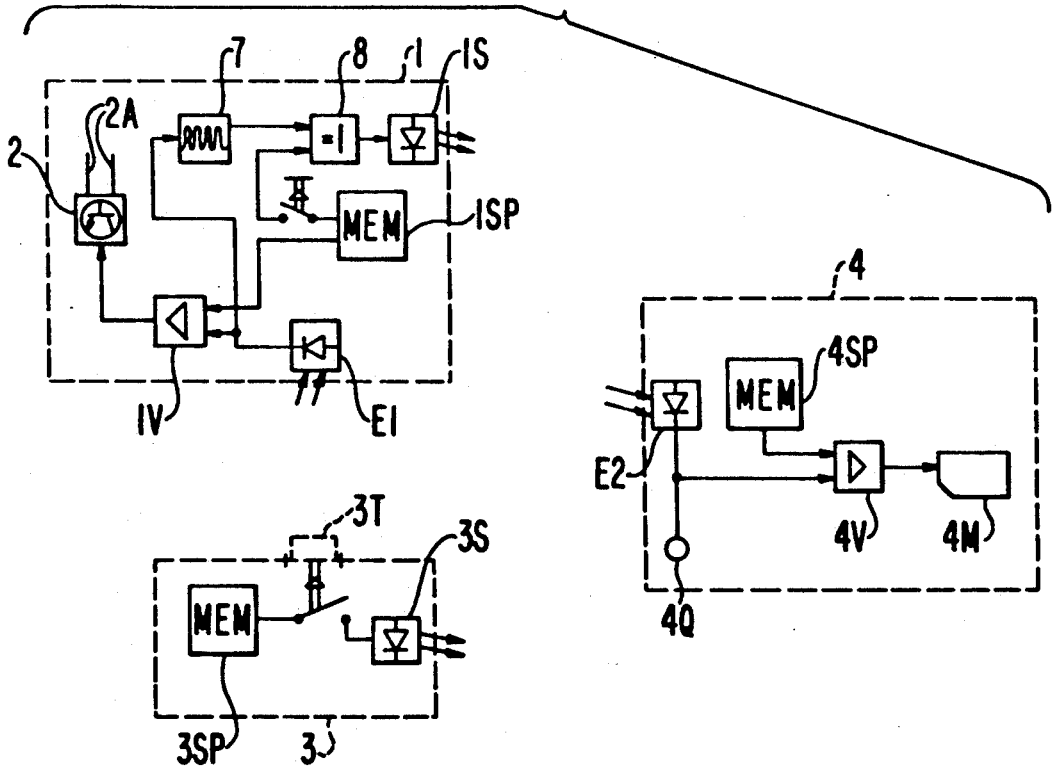
FIG. 3 shows a diagrammatic representation of a circuit constructed according to an embodiment of the present invention that is internal to the vehicle for protecting the remote-control system against the undesired triggering of switching effects.

FIG. 3 shows a second embodiment of a technical safety precaution against the simultaneous response of the drive 4M of the access control device 4 and of the vehicle locking when a control signal radiated from the hand transmitter 3 is received simultaneously at one of the first receivers E1 and at the second receiver E2. The vehicle 1, the hand transmitter 3 and the access control device 4 are represented there in the same configuration as in FIG. 2. The hand transmitter 3 is identical to that shown in FIG. 2. In the vehicle 1, instead of the signal repetition circuit shown in FIG. 2, an interference-signal transmitter 7, in the form of a multivibrator or noise generator or the like, and an OR element 8 are now provided.

The interference-signal transmitter 7 can be triggered directly by the first receiver or receivers E1, its output is connected via the OR element 8 to the transmitter or transmitters 1S fixed to the vehicle. The touch-contact switch 1T, also, is connected to the same transmitter 1S via the OR element 8. There is now no longer any need for a counting stage in the access control device 4, and the output of the second receiver E2 is now connected directly to the corresponding input of the comparator 4V. In addition, there is also provided an acknowledgement indicator 4Q, for example an indicator lamp, which can be switched on by the second receiver E2 independently of the identifiability of a received control signal as suitable, and which is visible outside the space which can be closed off by the access control device 4.

In this version, both the vehicle locking (control unit 2) and the access control device 4 can be controlled remotely by means of a single actuation of the transmission key 3T of the hand transmitter 3. However, when a signal radiated from the hand transmitter 3 via its emitter 3S is received by the first receiver or receivers E1, the interference-signal transmitter 7 is activated immediately. An indeterminate interference or noise signal is then radiated via the transmitter or transmitters IS fixed to the vehicle. Outside the vehicle 1, this is superposed on the control signal of the hand transmitter 3 in such a way that its coding can no longer be identified.

Now when, in a configuration according to FIG. 1, the control signal of the hand transmitter 3 is radiated simultaneously to the first receiver or receivers E1 and the second receiver E2, the second receiver E2 admittedly receives a signal which it can pass on as a result of its "suitable" characteristics, in order to switch on the acknowledgement indicator 4Q. However, this signal, which, as already described, consists of the superposition of the control signal and interference signal, cannot be identified by the comparator 4V as matching the filed code. Consequently, in the configuration mentioned, the drive 4M of the access control device 4 is not activated. The acknowledgement indicator 4Q merely signals to the user that a signal of some kind has been received. In the absence of any reaction of the access control device 4, the user will therefore not harbor doubts as to whether the hand transmitter 3 has perhaps failed.

For the effective remote control of the access control device 4, the user must then ascertain whether the vehicle 1 is, for example, outside the pivoting range of the garage door 5, and then deliberately direct the hand transmitter 3 entirely away from the second receiver E2 to the first receiver E1 or, if facing away from the vehicle 1, to the second receiver E2. It should further be noted that the above-described technical safety precaution internal to the vehicle becomes effective only in the already frequently mentioned critical situation of the simultaneous delivery of the control signal to the first and the second receivers. Normally, when the vehicle is parked at a sufficient distance from the access control device 4 which is to be controlled remotely by the hand transmitter 3, the safety precaution does not have an inhibiting effect on its remote controllability.

The interference signal could per se also be radiated via a separate transmitter fixed to the vehicle 1 which is different from the transmitter or transmitters IS fixed to the vehicle 1. However, the illustrated embodiment of a double utilization of the transmitter or transmitters IS to be provided in any case is more advantageous for useful purposes and for interference purposes.

In the second embodiment described above, therefore, the chain comprising the first receivers E1/interference-signal transmitter 7/OR element 8/transmitter or transmitters 1S fixed to the vehicle provides an electrical circuit exclusively internal to the vehicle for preventing the triggering of switching effects by the second receiver unit E2/4SP/4V when a control signal radiated as a result of the actuation of the transmission key of the hand transmitter 3 for the purpose of the remote control of the vehicle locking is received simultaneously by the first and the second receiver unit E1, E2. In this instance of reception, there arrives at the second receiver unit only a control signal which differs significantly, particularly in its superposition with the blocking or interference signal radiated from the vehicle 1, from a control signal radiated as a result of the actuation of the transmission key 3T of the hand transmitter 3 for the purpose of the remote control of the access control device 4.

Both in the first and in the second embodiment of the present invention, it can be expedient for further increase in convenience to radiate the control signal more than once in succession in response to a single random activation by the touch-contact switch 1T of the transmitter 1S fixed to the vehicle 1. This feature allows the vehicle user to control the access control device 4 remotely during a slow approach even from some distance away. When the user actuates the touch-contact switch 1T, on further approach to the access control device 4 the second receiver E2 in any event receives more than once the signal necessary for activating the drive 4M. Access to the garage, parking area or factory premises, etc. is cleared in good time. Preferably, for this there is in the vehicle 1 a timer which can be started by the touch-contact switch 1T and which predetermines for the transmitter 1S a time interval for the repeated radiation of the control signal. However, it should not be possible for the timer to be started by means of the first receiver E1. The time interval could amount, for example, to 5 seconds, but is fixed flexibly according to the user's specific requirements and depending on the conditions of approach to the access control device 4.

The reliability of the coding of contactlessly transmitted control signals can be ensured in many ways. For example, the code can be varied manually by the user via a group of coding switches, in a known manner. It has also already been proposed to transmit each control signal in the form of a two-part code-word, the first portion of which is stored as specific to the object and as invariable for the user in the hand transmitter and in the vehicle, while a second portion of the code-word is varied algorithmically and consequently prevents the successful use of inadmissibly recorded code-words (German Patent Document P 39 05 651.1-32). Under specific conditions, the variable portion of the code-word can be entered anew in the vehicle's own code-word store by the user by means of the hand transmitter. Similar features can also be employed in an expedient way within the access control device 4 in the framework of the remote-control system according to the invention, as now described with reference to FIG. 4.

According to this embodiment, the storage device 4SP of the access control device 4 is an EEPROM, in which a code can be entered via the second receiver E2, for example by means of a hand transmitter or a transmitter fixed to the vehicle 1. It is, of course, ensured that this entry operation can be carried out only under specific restrictions. For example, in a manner known per se a key switch KEY is provided which has to be actuated by an authorized user by means of a mechanically coded key 9, before the storage device 4SP of the access control device 4 accepts a new code entered via the second receiver E2. The entry of a new code is necessary, above all, when either a hand transmitter 3 is lost or the vehicle 1 together with the hand transmitter 3 has been sold.

Figure 4:
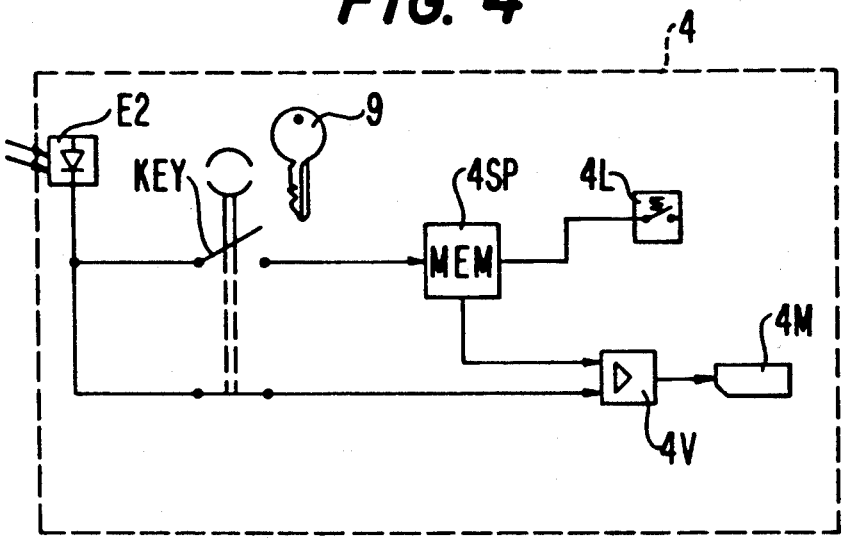
FIG. 4 shows a diagrammatic representation of a programmable code storage device of the access control device constructed according to an embodiment of the present invention.

In FIG. 4, for illustrative purposes the key restriction is indicated in simplified form by the fact that an input line of the storage device 4SP can be closed by the key switch KEY. A coded signal received by the receiver E2 with the key switch KEY closed and of suitable character (code type, word length, etc.) is filed in the storage device 4SP via the input line and for further operations of the remote control of the access control device 4 takes the place of the code used hitherto.

If the access control device 4 is to be controlled remotely by a plurality of entitled users or by means of a plurality of equally entitled hand transmitters 3, then a corresponding plurality of code storage locations can be provided in the storage device 4SP. Before the entry of a new code, a storage-location preselection then also has to be additionally carried out. This could be performed by a multi-stage key switch or via an appropriate keyboard. For devices with a large number of authorized users, that is to say, for example, at factory gates or the like, a programming of the associated code stores is appropriately carried out computer-aided. The total quantity of all the codes to be stored thus constitutes a data record which, if required, can be changed by authorized persons and then reentered and stored as a whole.

Should a plurality of storage locations be provided for different codes, then the access control device 4 is so designed for this purpose that, after each reception of a control signal in the form of a code-word, the entire code that is stored is examined for a suitable combination.

FIG. 4 also indicates that, in addition to the key switch KEY, a break contact coupled mechanically to the switch can be inserted into the connection between the second receiver E2 and the comparator 4V. This break contact can ensure that the drive 4M of the access control device 4 is not activated immediately when a new code is entered.

According to a further embodiment, in the access device 4 a code-erasing device 4L can also be provided, for example in the form of an erasing key indicated symbolically, which makes it possible to erase the stored code. This can be actuated, above all, as an emergency measure after the loss of a hand transmitter. Erasure of the stored code or codes prevents the remote control of the access control device 4 until a new entry has been made. Selective erasability of an individual code or of an individual storage location can, of course, be provided here.

The choice of the type of code-words is arbitrary per se. However, in view of the already mentioned known division of all code-words into object-specific and variable portions, it is possible, for example to store only the object-specific portion of each code-word in the storage device 4SP of the access control device 4. The algorithmically variable portion of the control signals or code-words radiated from the transmitters 1S or 3S is then not used for the remote control of the access control device 4. Algorithmic variations of the variable portion of the transmitter code-words taking place outside the reception range of the second receiver E2 cannot then impair the remote control of the access control device 4.

Figure 5:
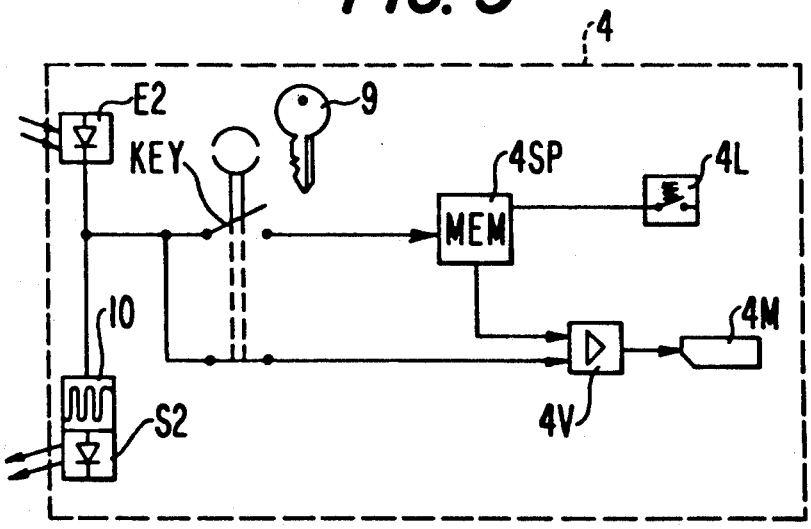
FIG. 5 shows a diagrammatic representation of an access control device constructed according to an embodiment of the present invention with an interference transmitter that provides protection for the remote-control system against the undesired triggering of switching effects.

In another embodiment of the present invention, illustrated in FIG. 5, an influencing of the switching effect of the first receiver or receivers E1 in the vehicle 1 by a transmitter S2 arranged on the access control device 4 can also be provided in a similar way to the second embodiment. By means of the stationary transmitter S2, an interference signal from an interference-signal transmitter 10 is radiated immediately after reception of a signal from the hand transmitter 3 or from the transmitter S1 fixed to the vehicle. When a control signal radiated from the hand transmitter 3 is received simultaneously by the first and the second receiver E1, E2, this interference signal also prevents a reaction of the vehicle locking. For the few instances when the simultaneous reception of signals radiated from the hand transmitter 3 is possible at the same time on the vehicle 1 and on the access control device 4, the user is obliged to direct the hand transmitter 3 deliberately entirely to that particular receiver for which the switching effects are to be triggered.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A remote-control system for closures, comprising:

a portable hand held transmitter which generates and radiates directed coded control signals upon actuation of a transmission key on the hand held transmitter;

at least one first receiver unit arranged on a motor vehicle, which first receiver unit it tuned to receive the control signals radiated from the hand held transmitter, and which triggers switching effects on a remotely controllable vehicle locking device after received control signals have been identified as acceptable;

at least one second receiver unit tuned to receive control signals radiated as a result of the actuation of the transmission key of the hand held transmitter for remotely controlling a remotely controllable access control device external to the motor vehicle, said second receiver unit being arranged outside the motor vehicle and triggering switching effected on the access control device after received control signals have been identified as acceptable;

electrical means for preventing at least the triggering of switching effects by the second receiver unit simultaneously with the triggering of switching effects by the first receiver unit in response to a control signal, which is radiated by the hand transmitter as a result of one single actuation of said transmission key and is received simultaneously by the first and the second receiver unit, and at least one additional transmitter fixed to the motor vehicle, said transmitter being randomly electrically activatable from a passenger space of the motor vehicle independently of the hand transmitter, said transmitter being arranged on the outside of the motor vehicle for direct radiation to the outside of control signals coded in accordance with the control signals radiated by the hand transmitter.

2. The remote-control system according to claim 1, wherein the electrical circuit is arranged external to the motor vehicle.

3. The remote-control system according to claim 2, wherein the electrical circuit external to the vehicle includes means for causing the second receiver unit to trigger a switching effect on the access control device only after the control signal that is radiated in response to a single actuation of the hand transmitter is received more than once by the second receiver unit.

4. The remote-control system according to claim 3, wherein the second receiver unit includes a second receiver and a comparator, and further comprising a counting stage coupled to the second receiver and containing an intermediate read-write store and a timer, said intermediate store storing each control signal received by the second receiver, the timer being started by the second receiver, wherein upon receipt of the same control signal twice within a period of time defined by the timer, the counting stage sends the control signal last stored in the intermediate store to the comparator of the second receiver unit, with the contents of the intermediate store being erased after the expiry of the defined period of time.

5. The remote-control system according to claim 4, further comprising an additional circuit internal to the motor vehicle, which automatically causes the control signal to be radiated at least twice by the transmitter fixed to the vehicle, upon a single random activation of the transmitter fixed to the motor vehicle.

6. The remote-control system according to claim 5, further comprising a timer for fixing a time interval, during which the transmitter fixed to the vehicle radiates the control signal repeatedly after a single random activation of the transmitter fixed to the vehicle.

7. The remote-control system according to claim 1, in which the electrical circuit is arranged in the motor vehicle.

8. The remote-control system according to claim 7, further comprising an auxiliary transmitter arranged in the motor vehicle and coupled to the electrical circuit, said auxiliary transmitter being automatically activated by said electrical circuit upon the activation of the hand transmitter, said electrical circuit being coupled to the first receiver unit, when a control signal of the hand transmitter is received by the first receiver unit, the automatic activation of the auxiliary transmitter causing the immediate radiation of a signal by the auxiliary transmitter which is similar to but differs significantly from the control signal of the hand transmitter, and is superposable on the control signal of the hand transmitter.

9. The remote-control system according to claim 8, wherein the transmitter fixed to the vehicle is the auxiliary transmitter, and further comprising two different signal sources for the signal to be radiated by the transmitter fixed to the vehicle, said signal sources being coupled to the transmitter fixed to the vehicle.

10. The remote-control system according to claim 1, further comprising means for dividing the control signals radiatable from the hand transmitter in the form of code-words into an invariable object-specific or vehicle-specific basic code-word portion and a variable portion; and a storage device in the access control device that stores the basic code-word portion, wherein only the basic codeword portion is radiated by the transmitter fixed to the motor vehicle.

11. The remote-control system according to claim 10, further comprising an erasing device in the access control device for erasing the content of the storage device.

12. The remote-control system according to claim 11, further comprising an entry device in the access control device which allows a new entry of a code in the storage device.

13. The remote-control system according to claim 12, further comprising a switchable connection coupled between the second receiver and an input of the storage device of the access control device and via which a new code can be entered in the storage device by the radiation of a coded control signal to the second receiver.

14. The remote-control system according to claim 7, further comprising an auxiliary transmitter in the access control device and coupled to the second receiver unit, said auxiliary transmitter being automatically activated when a control signal is received by the second receiver unit, the automatic activation of the auxiliary transmitter causing the immediate radiation of a signal by the auxiliary transmitter which is similar to but differs significantly from the control signal of the hand transmitter, and is superposable on the control signal of the hand transmitter.

15. The remote-control system according to claim 1, further comprising an indicator device coupled to the second receiver unit which, when a control signal is received, is switched on by the second receiver unit independently of the identifiability of the received control signal as acceptable.

16. The remote-control system according to claim 3, further comprising an additional circuit internal to the motor vehicle, which automatically causes the control signal to be radiated at least twice by the transmitter fixed to the vehicle, upon a single random activation of the transmitter fixed to the motor vehicle.

17. The remote-control system according to claim 3, further comprising means for dividing the control signals radiatable from the hand transmitter in the form of code-words into an invariable object-specific or vehicle-specific basic code-word portion and a variable portion; and a storage device in the access control device that stores the basic code-word portion, wherein only the basic codeword portion is radiated by the transmitter fixed to the motor vehicle.

18. The remote-control system according to claim 8, further comprising means for dividing the control signals radiatable from the hand transmitter in the form of code-words into an invariable object-specific or vehicle-specific basic code-word portion and a variable portion; and a storage device in the access control device that stores the basic code-word portion, wherein only the basic codeword portion is radiated by the transmitter fixed to the motor vehicle.

19. The remote-control system according to claim 10, further comprising an entry device in the access control device which allows a new entry of a code in the storage device.

20. The remote-control system according to claim 19, further comprising a switchable connection coupled between the second receiver and an input of the storage device of the access control device and via which a new code can be entered in the storage device by the radiation of a coded control signal to the second receiver.

21. The remote-control system according to claim 2, further comprising an auxiliary transmitter in the access control device and coupled to the second receiver unit, said auxiliary transmitter being automatically activated when a control signal is received by the second receiver unit, the automatic activation of the auxiliary transmitter causing the immediate radiation of a signal by the auxiliary transmitter which is similar to but differs significantly from the control signal of the hand transmitter, and is superposable on the control signal of the hand transmitter.

22. The remote-control system according to claim 3, further comprising an indicator device coupled to the second receiver unit which, when a control signal is received, is switched on by the second receiver unit independently of the identifiability of the received control signal as acceptable.

23. The remote-control system according to claim 8, further comprising an indicator device coupled to the second receiver unit which, when a control signal is received, is switched on by the second receiver unit independently of the identifiability of the received control signal as acceptable.

* * * * *